US010189601B2

(12) United States Patent
Grutt

(10) Patent No.: US 10,189,601 B2
(45) Date of Patent: Jan. 29, 2019

(54) ADJUSTABLE PALLET

(71) Applicant: Caterpillar Inc., Peoria, IL (US)

(72) Inventor: Adam J. Grutt, Menomonie, WI (US)

(73) Assignee: Caterpillar Inc., Deerfield, IL (US)

( * ) Notice: Subject to any disclaimer, the term of this patent is extended or adjusted under 35 U.S.C. 154(b) by 0 days.

(21) Appl. No.: 15/461,116

(22) Filed: Mar. 16, 2017

(65) Prior Publication Data

US 2018/0265249 A1 Sep. 20, 2018

(51) Int. Cl.

| | |
|---|---|
| ***B65D 19/44*** | (2006.01) |
| ***B65D 19/00*** | (2006.01) |
| ***B65D 19/38*** | (2006.01) |
| ***B65D 19/40*** | (2006.01) |

(52) U.S. Cl.

CPC ..... *B65D 19/44* (2013.01); *B65D 19/0012* (2013.01); *B65D 19/385* (2013.01); *B65D 19/40* (2013.01); *B65D 2519/00273* (2013.01); *B65D 2519/00278* (2013.01); *B65D 2519/00368* (2013.01); *B65D 2519/00781* (2013.01); *B65D 2519/00796* (2013.01); *B65D 2519/00815* (2013.01); *B65D 2519/00955* (2013.01)

(58) Field of Classification Search

CPC .. B65D 19/44; B65D 19/0012; B65D 19/385; B65D 19/40; B65D 19/0095; B65D 19/38; B65D 2519/00024; B65D 2519/00059; B65D 2519/00094; B65D 2519/00273; B65D 2519/00293; B65D 2519/00323; B65D 2519/009373; B65D 2519/00572; B65D 2519/00985; B65D 2519/0099; B65D 2519/00278; B65D 2519/00368; B65D 2519/00781; B65D 2519/00796; B65D 2519/00815; B65D 2519/00955; B64C 1/20; B64C 1/22

USPC ..... 108/53.1, 53.3, 53.5, 56.1, 56.3, 57.29, 108/57.31, 57.32, 57.33, 57.17, 57.18, 108/57.19, 91, 55.1, 51.3, 51.11; 248/346.02

See application file for complete search history.

(56) References Cited

U.S. PATENT DOCUMENTS

| | | | | | |
|---|---|---|---|---|---|
| 697,237 | A | * | 4/1902 | Collins | |
| 2,579,655 | A | * | 12/1951 | Archibald | B65D 19/12 108/53.1 |
| 2,863,568 | A | * | 12/1958 | Skubic | B65D 19/385 108/53.5 |
| 3,180,288 | A | * | 4/1965 | McCowan | A47B 87/0246 108/101 |
| 3,193,093 | A | * | 7/1965 | Hansen | B65G 49/062 108/53.1 |

(Continued)

FOREIGN PATENT DOCUMENTS

| | | | |
|---|---|---|---|
| EP | 2687454 | * | 1/2014 |
| FR | 2768406 | * | 3/1999 |
| WO | WO-2007/119320 A1 | | 10/2007 |

*Primary Examiner* — Janet M Wilkens

(74) *Attorney, Agent, or Firm* — Miller, Matthias & Hull

(57) ABSTRACT

A pallet for transporting a plurality of differently shaped parts is disclosed. The pallet including a rectangular base having a planar top surface, the top surface having a plurality of holes arranged thereon in a round staggered configuration, a bottom support connected to the underside of the rectangular base, each ski located along the underside of an edge of the rectangular bed, four rectangular pillars located at the four corners of the rectangular base and extending upwardly.

17 Claims, 12 Drawing Sheets

(56) References Cited

U.S. PATENT DOCUMENTS 3,400,671 A * 9/1968 Erismann ..... B65D 19/0095 108/53.5
3,521,764 A * 7/1970 Loomis ..... B65D 21/0209 108/53.1
3,616,766 A * 11/1971 Weiss ..... B65D 19/0097 108/57.18
4,437,412 A * 3/1984 Trautsch ..... B65D 19/385 108/115
4,782,763 A 11/1988 Salloum
4,915,033 A 4/1990 Bond
4,977,836 A * 12/1990 Bond ..... B65D 19/44 108/55.1
5,400,904 A * 3/1995 Maston, III ..... H01L 21/67333 206/509
5,404,821 A * 4/1995 Bond ..... B65D 19/44 108/55.1
5,411,360 A * 5/1995 Hilliker ..... B60P 1/02 108/53.5
5,497,708 A 3/1996 Jeruzal
5,647,284 A * 7/1997 Frysinger ..... B65D 19/385 108/53.1
5,809,906 A * 9/1998 Janek ..... B65D 19/0091 108/143
5,887,529 A 3/1999 John et al.
6,170,686 B1 * 1/2001 Flores ..... B65D 7/24 220/4.33
6,343,555 B1 * 2/2002 Arai ..... B65D 19/385 108/53.5
6,606,955 B2 8/2003 Warren
7,044,066 B1 * 5/2006 Miller ..... B65D 19/44 108/54.1
7,802,526 B2 9/2010 Brady et al.
8,453,861 B2 * 6/2013 Joubert ..... B65D 19/12 206/600
2001/0009639 A1 * 7/2001 Gunn ..... A47B 57/10 414/286
2005/0127072 A1 * 6/2005 Schmidt ..... B65D 19/16 220/4.28
2006/0086881 A1 * 4/2006 Miller ..... A47B 91/005 248/346.01
2008/0073341 A1 * 3/2008 Avery ..... B65D 7/24 220/9.4
2013/0101381 A1 * 4/2013 Fell ..... B65D 19/44 414/800

* cited by examiner

ADJUSTABLE PALLET

TECHNICAL FIELD

This disclosure generally relates to pallets and, more specifically, related to pallets for holding differently shaped and sized objects.

BACKGROUND

Pallets support goods in a stable fashion during transport. Such pallets are typically planar in shape with opening or handles facilitating being lifted by a forklift, pallet jack, front loader, work saver, or other jacking device, or, in some cases a crane. Goods or shipping containers are often placed on a pallet and secured with strapping, stretch wrap or shrink wrap and shipped. Containerization for transport has spurred the use of pallets because shipping containers have the smooth, level surfaces needed for easy pallet movement. Organizations using standard pallets for loading and unloading can have much lower costs for handling and storage, with faster material movement than businesses that do not.

In addition to long distance transport, in various fields of work, for example manufacturing, objects of various shapes and sizes are transported on pallets within a manufacturing facility between steps of manufacture. Such objects can be manipulated, assembled, machined, or otherwise handled at on station, but then there is a need for quick changeover of assembly systems to facilitate manufacturing at a subsequent station. Oftentimes, users and operators require multiple pallets of multiple sizes dedicated to specific articles being built and shipped. Such custom racks often are specifically tailored to a single piece they are designed to hold, and therefore are quickly discarded and/or stored after only minimal use. This waste adds to the cost of manufacturing.

For example, pallets for use with low-volume parts often are equipped with slots, clips, rings, protrusions and various other constructions fixed thereon which are specifically adapted for the part or parts in question. In addition, properly sized and customized pallets are not often on hand for a part that is ready to be worked on and/or transported to another portion of the facility.

U.S. Pat. No. 5,497,708 Jeruzal ("Jeruzal") discloses a multiple section pallet assembly having a primary pallet member fitted with adjustable article attachment brackets thereon to accommodate and attach vehicle seats of varying sizes. While usually effective for its intended purpose, improvements are needed.

The present disclosure is directed to solving one or more of the issues discussed above and those contained in the prior art.

SUMMARY

In accordance with one aspect of the present disclosure, a modular pallet system is disclosed. The modular pallet system may include a pallet, the pallet including a rectangular base having a planar top surface, and a planar bottom surface spaced apart from the planar top surface, the planar top surface having a plurality of holes arranged thereon, and the planar bottom surface having a plurality of holes arranged to align with the holes of the planar top surface, the holes of the planar bottom surface being smaller in diameter than the holes of the planar top surface. A plurality of stacking arms extending upwardly from the rectangular base, the arms being oriented generally perpendicular to the top surface. A support connected to the bottom of the base for supporting the modular pallet. A plurality of part holders cooperable with the top surface of the base and mounted on the base generally perpendicular to the top surface.

In accordance with another aspect of the present disclosure, a pallet for transporting a plurality of differently shaped parts is disclosed. The pallet including a rectangular base having a planar top surface, the top surface having a plurality of holes arranged thereon in a round staggered configuration. A plurality of support skis connected to the underside of the rectangular base, each ski located along the underside of an edge of the rectangular bed. A plurality of rectangular pillars located at the corners of the rectangular base and extending upwardly, each of the pillars connected at the side to an end of at least one of the skis.

In accordance with another embodiment of the present disclosure, an adjustable pallet for holding parts is disclosed. The adjustable pallet including a rectangular base having a planar top surface, and a planar bottom surface spaced apart from the top surface, the top surface having a plurality of holes arranged thereon in a round staggered configuration, and the bottom surface having a plurality of holes arranged in a round staggered configuration to align with the holes of the top surface, the holes of the bottom surface being smaller in diameter than the holes of the top surface, and a support connected to the bottom of the base for supporting the adjustable pallet. A plurality of part holders cooperable with the top surface of the base and mounted on the base generally perpendicular to the top surface may be incorporated.

These and other aspects and features of the present disclosure will be more readily understood when read in conjunction with the accompanying drawings.

BRIEF DESCRIPTION

Figure 3:
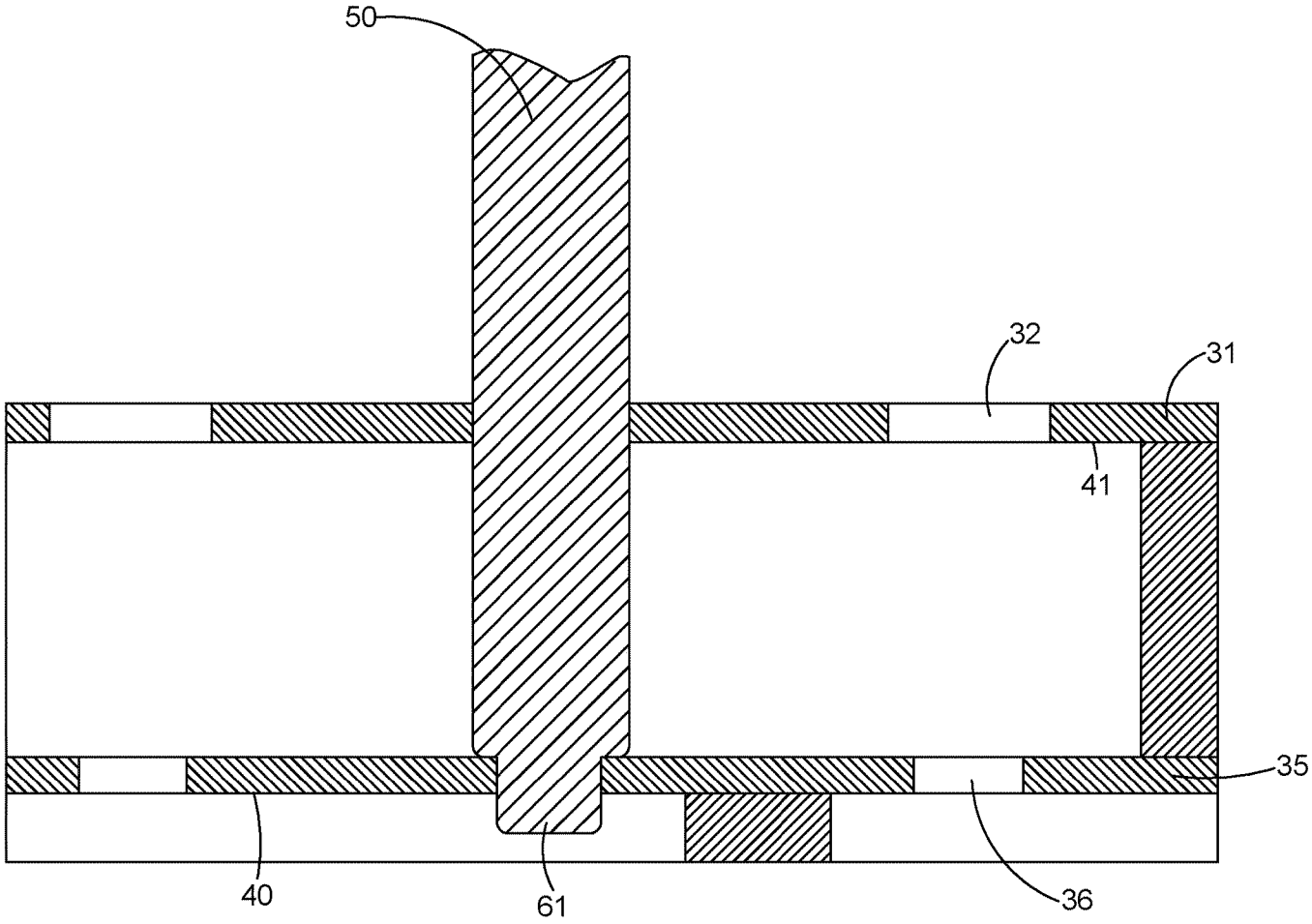

FIG. 3. is a sectional view of the base of an adjustable pallet and holding pin according to the present disclosure.

Figure 1:
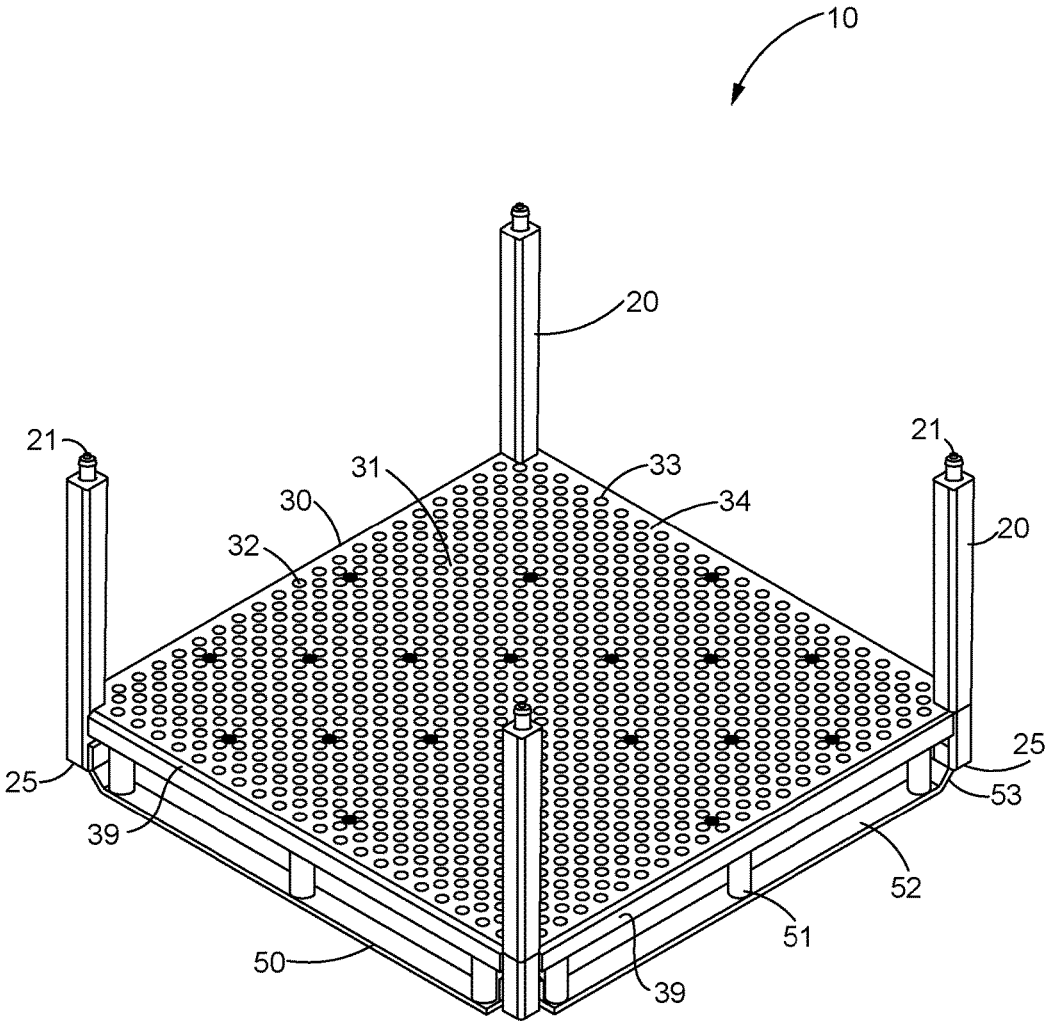
FIG. 1 is a perspective view of an adjustable pallet according to the present disclosure.
Figure 4:
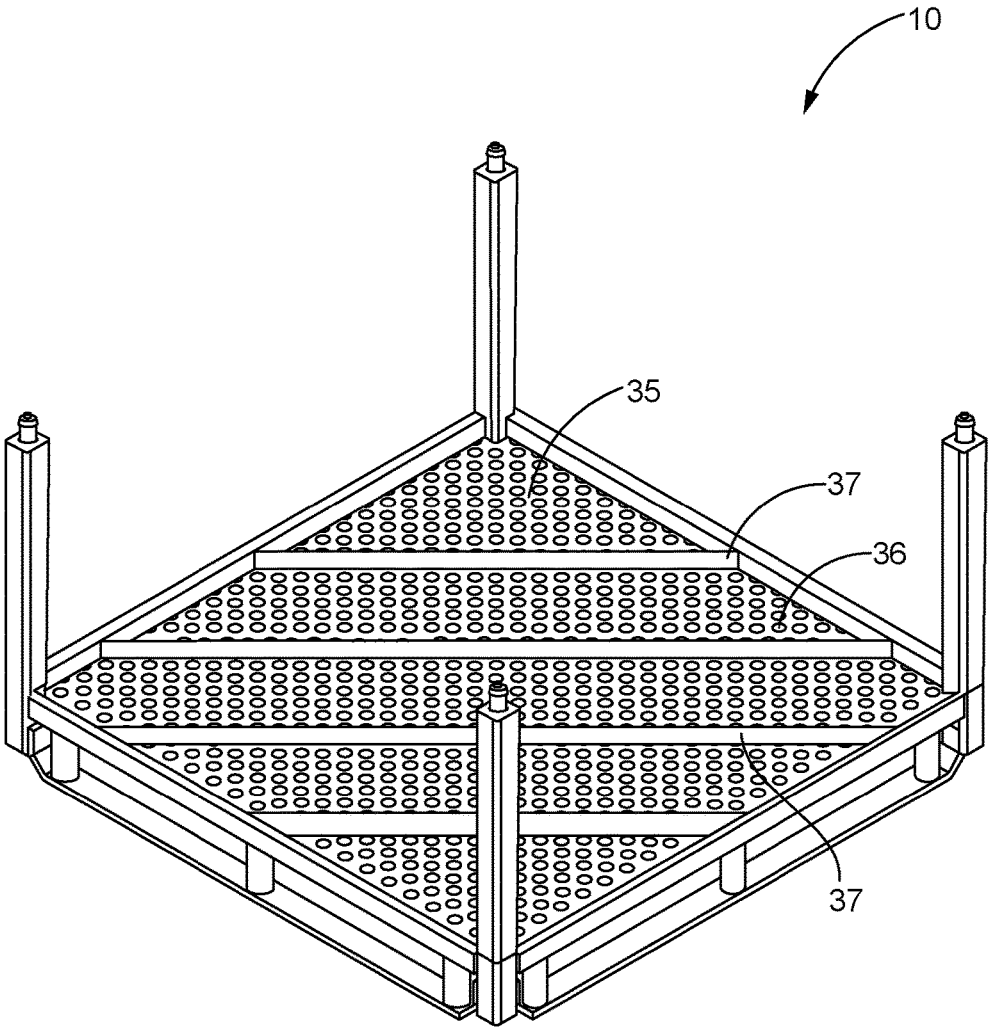

FIG. 4 is a perspective view of the adjustable pallet of FIG. 1. with the top surface removed.

Figure 5:
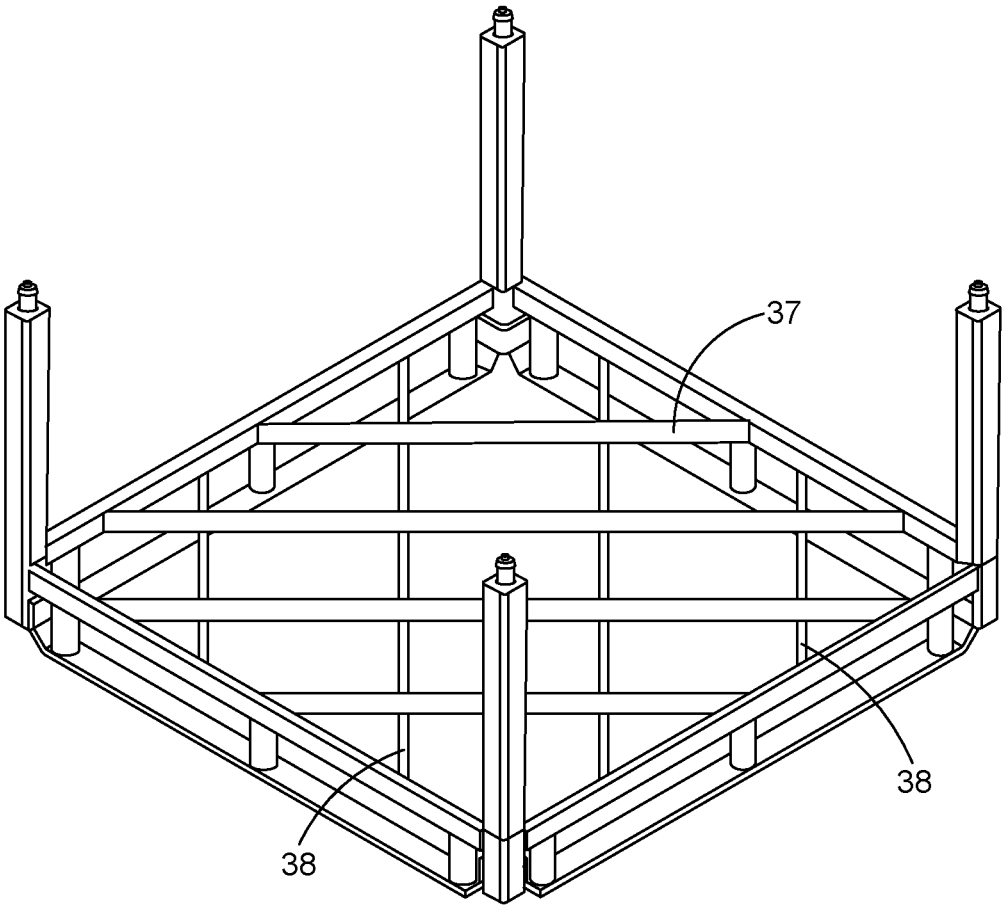

FIG. 5 is a perspective view of the adjustable pallet of FIG. 1. with the top and bottom surfaces removed.

Figure 6:
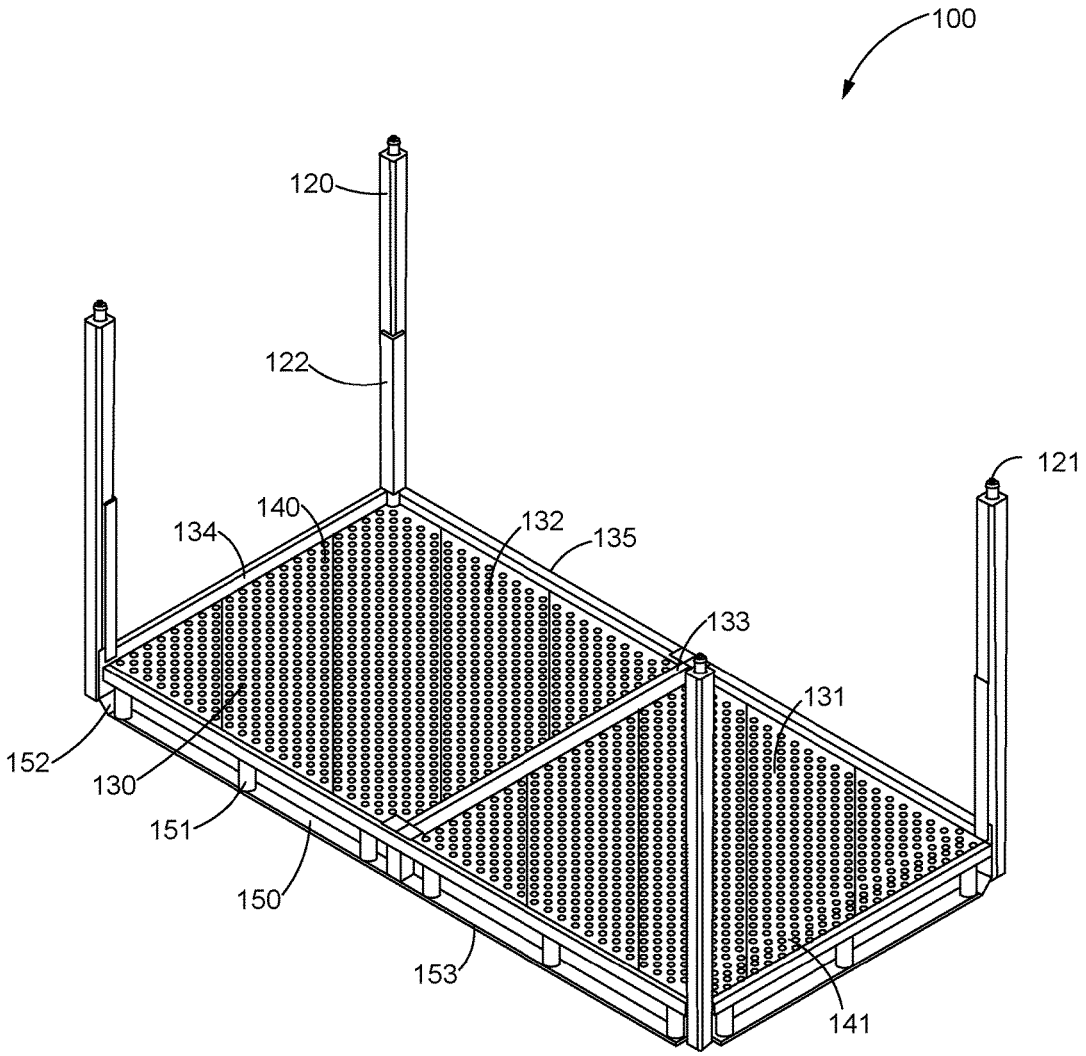
Figure 7:
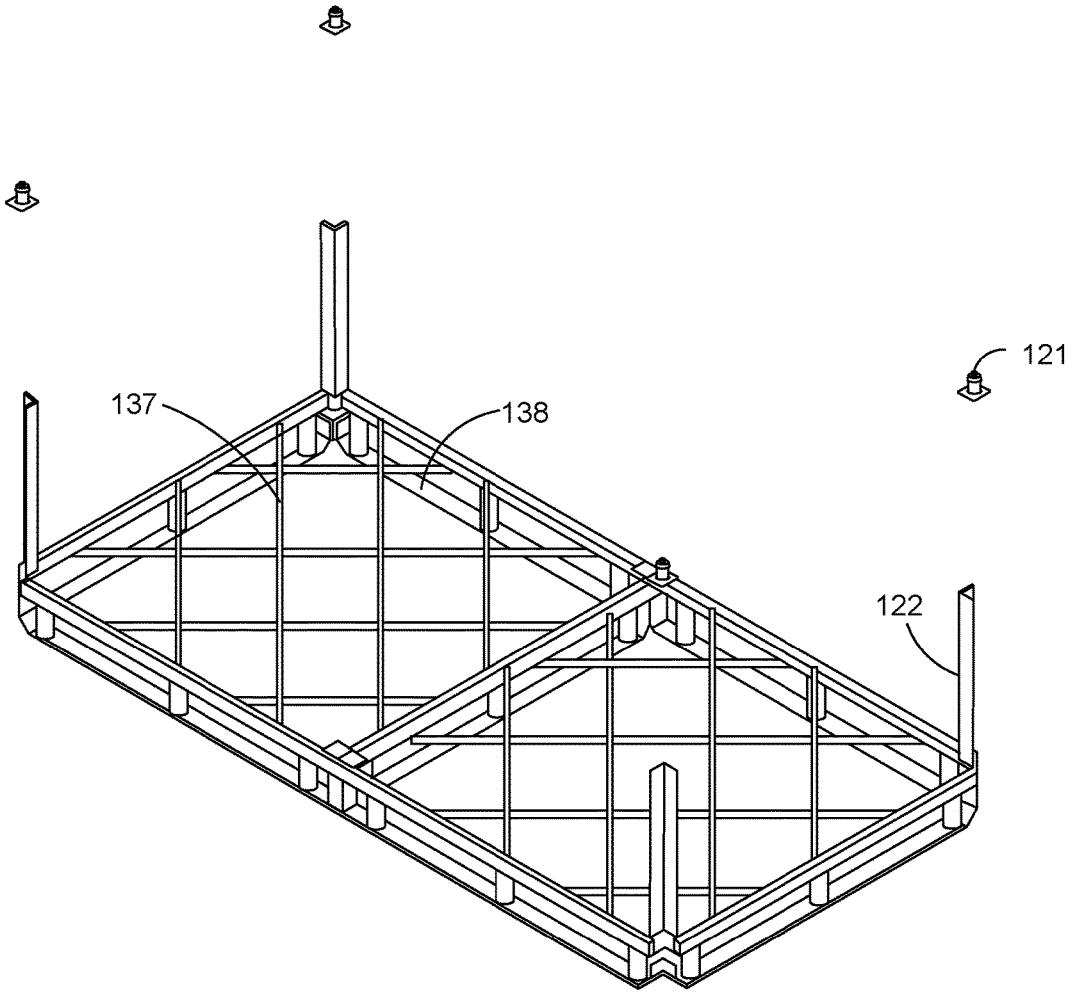

FIG. 6 is a perspective view of an another embodiment of an adjustable pallet according to the present disclosure FIG. 7 is a perspective view of the adjustable pallet of FIG. 6. with supporting arms, and the top and bottom surfaces removed.

Figure 8:
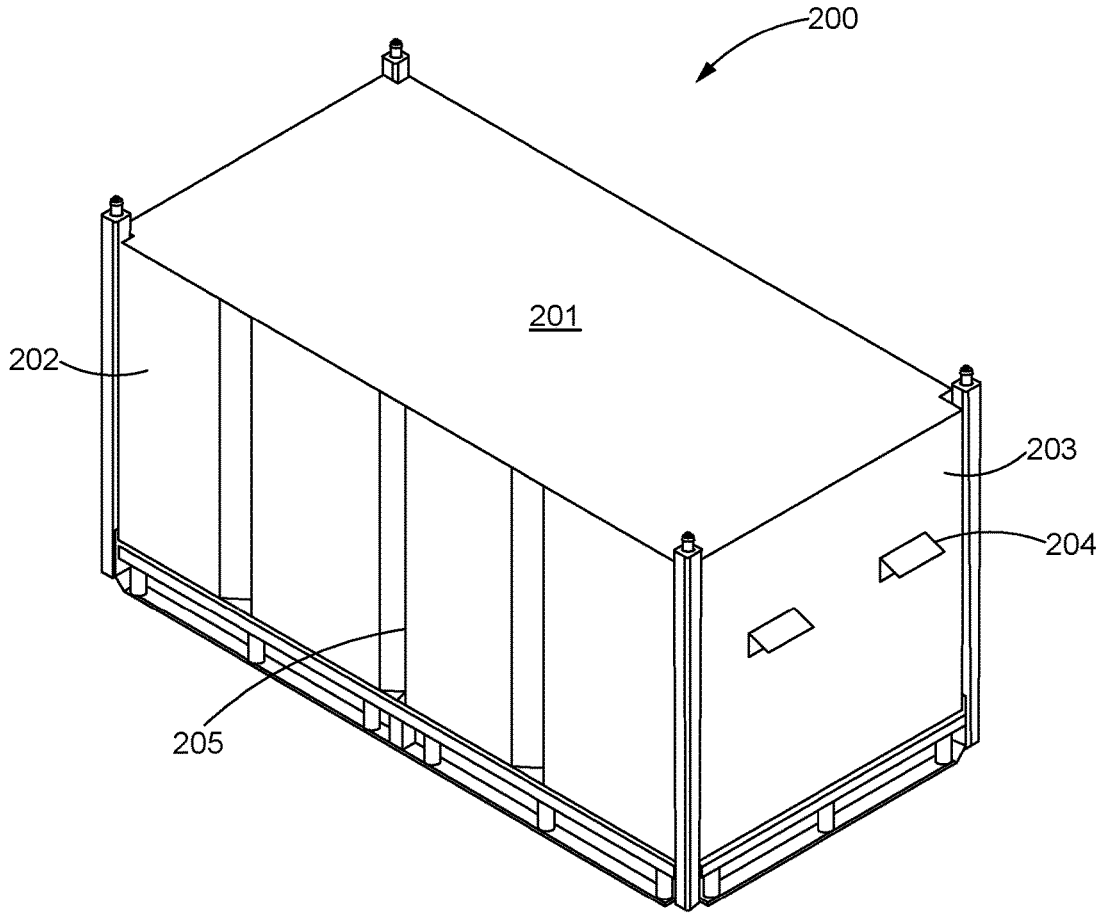

FIG. 8 is a perspective view of the adjustable pallet of FIG. 7. with a cover.

Figure 9:
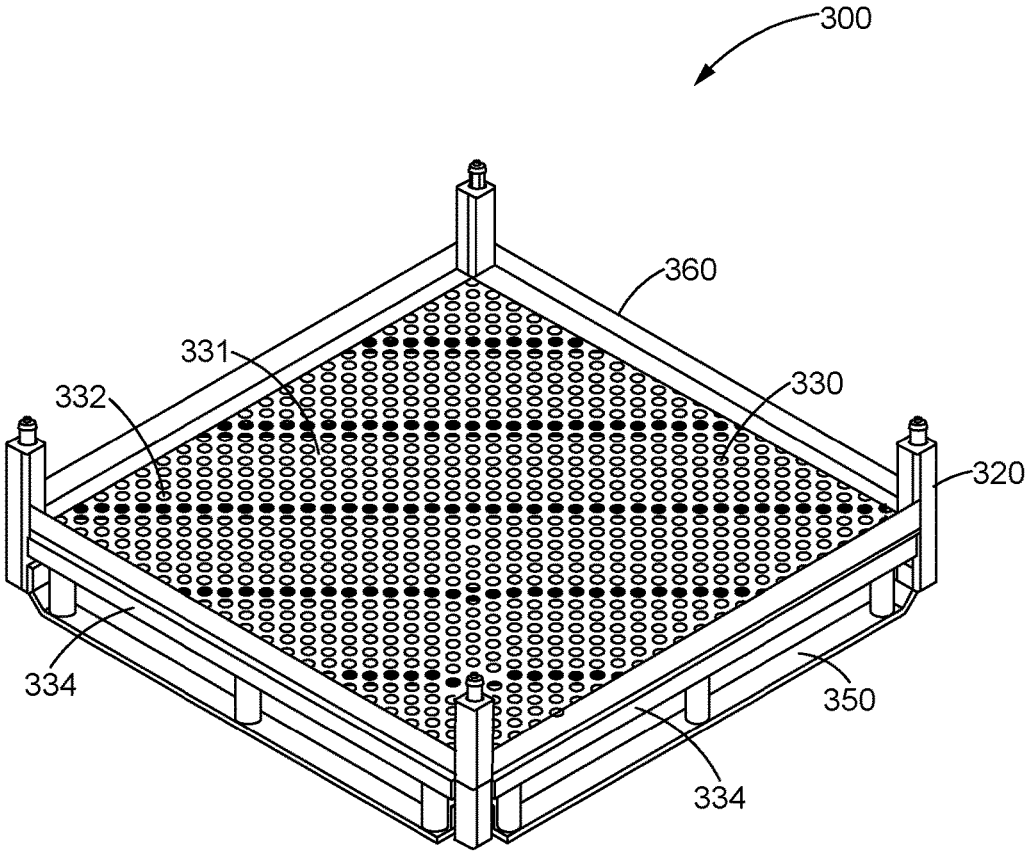

FIG. 9 is a perspective view of another embodiment of an adjustable pallet having a lip according to the present disclosure.

Figure 10:
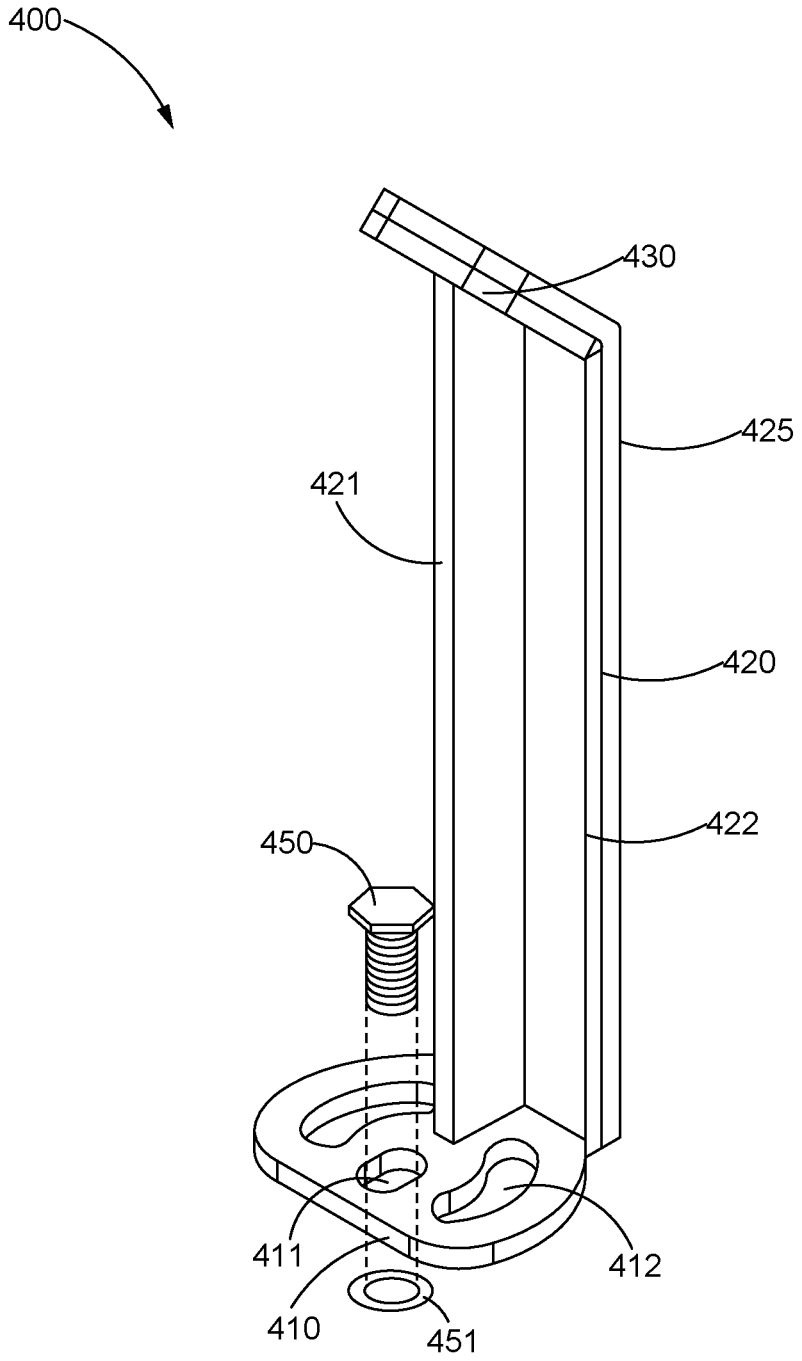

FIG. 10 is a perspective view of a part holder according to the present disclosure.

Figure 11:
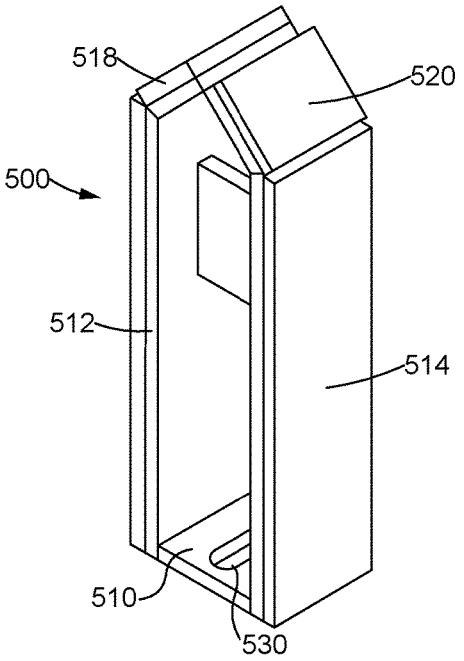

FIG. 11 is a perspective view of an alternative embodiment of a part holder according to the present disclosure.

Figure 12:
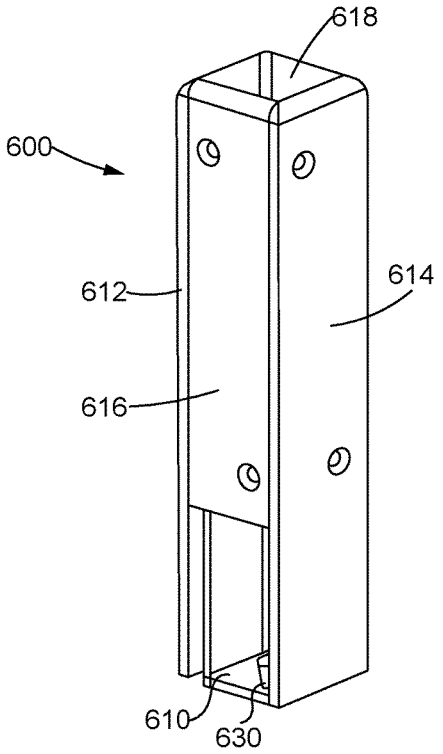

FIG. 12 is a perspective view of another alternative embodiment of a part holder according to the present disclosure.

Figure 13:
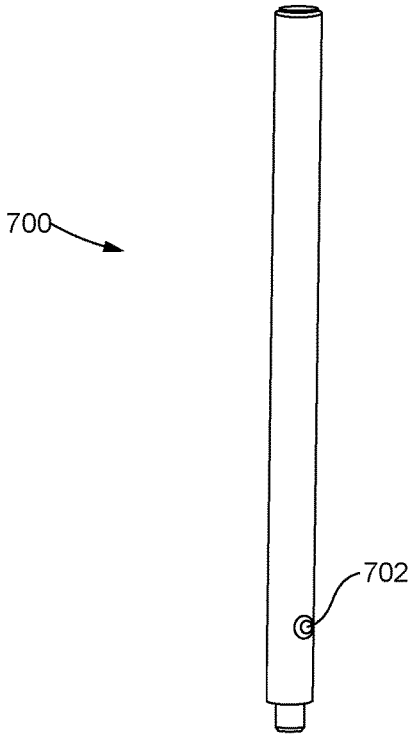

FIG. 13 is a perspective view of an alternative embodiment of a support pin according to the present disclosure.

Figure 14:
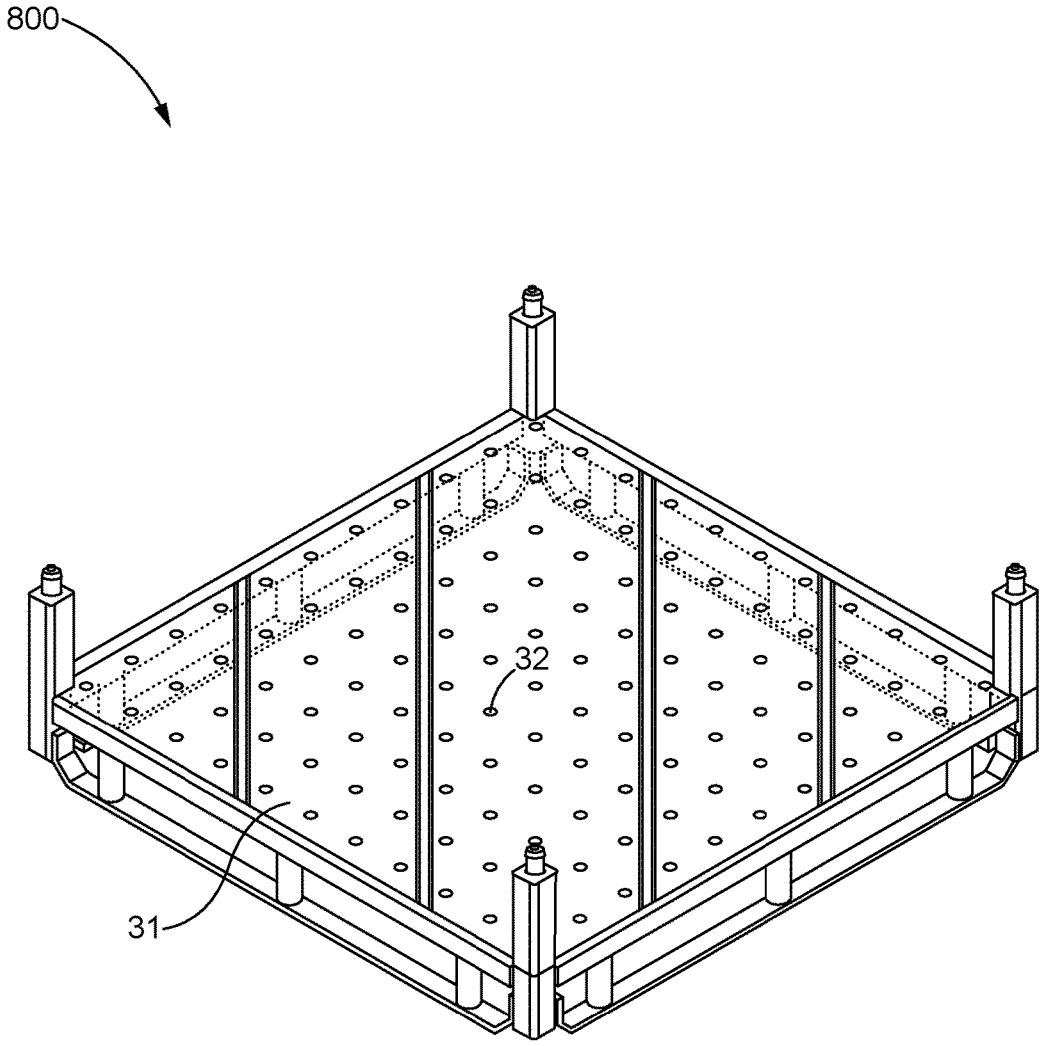

FIG. 14 is a perspective view of an alternative embodiment of an adjustable pallet according to the present disclosure.

DETAILED DESCRIPTION OF THE DISCLOSURE

Figure 2:
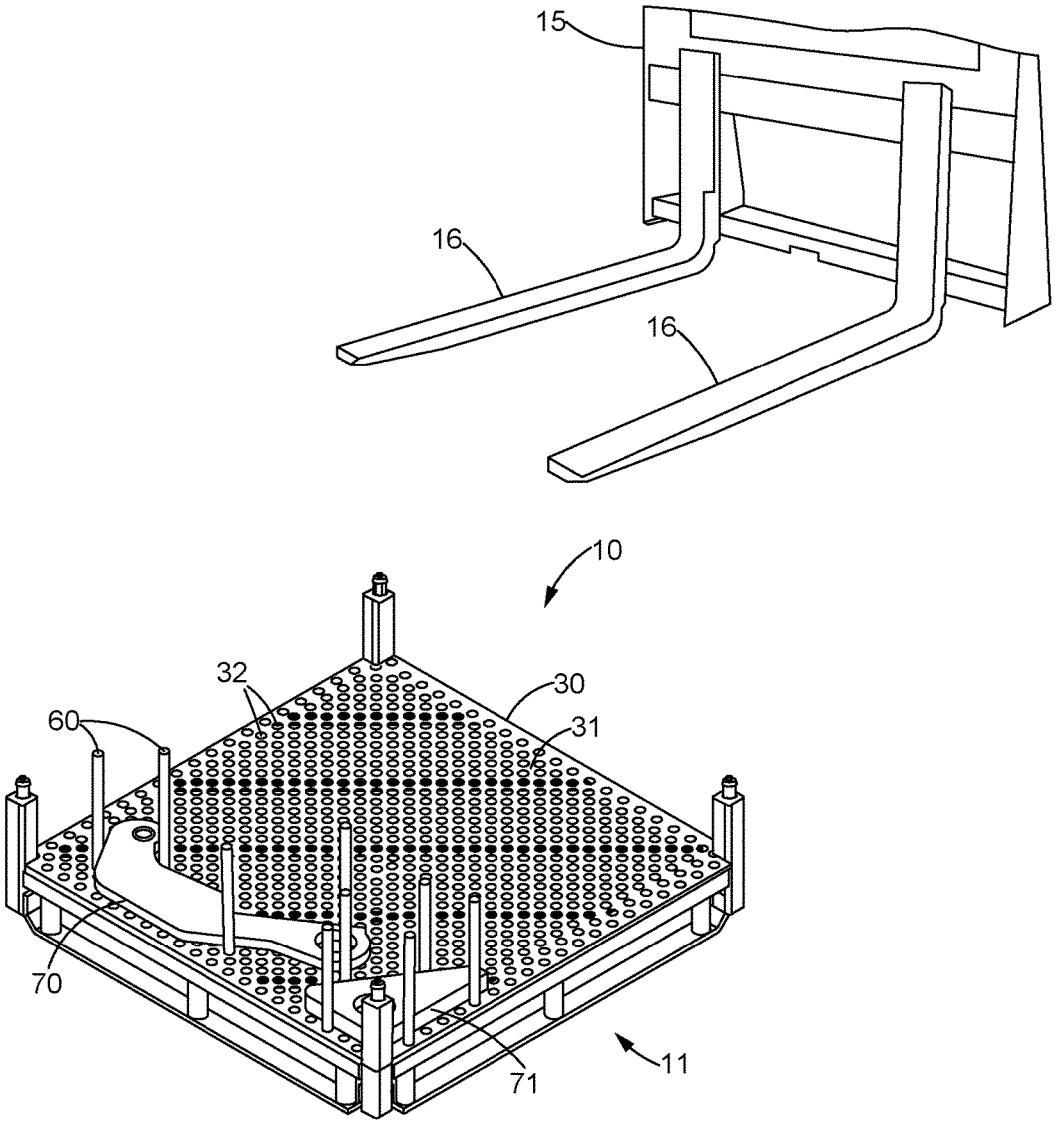
FIG. 2 is a perspective view of an adjustable pallet according to the present disclosure holding exemplary parts in place with part holding pins and cooperable with a lift fork.

Referring now to the drawings and with specific reference to FIG. 1, a pallet 10 is shown. Such pallets 10 can be used in various industrial and commercial applications such as transporting objects of varied three dimensional (3-D) shapes to end users after manufacture, as well as for moving parts within a given manufacturing facility between various work stations such as painting systems, milling machines, and other such applications. Pallet 10 can be constructed from a wide variety of materials including metals such as steel and aluminum, polymers such as propylene, and other materials known to those skilled in the art. The pallet 10 may include a plurality of arms 20, a base 30, and a plurality of supports 50 which will be described in greater detail herein. As shown in FIGS. 1 & 2, the arms 20 can be tipped by dowel heads 21 which are matable to bottom sides 25 of arms 20 such that multiple pallets 10 can be stacked forming a modular pallet system 11.

Looking to FIGS. 1 & 3-5, various other aspects of the base 30 are demonstrated. A top surface 31 of the base 30 contains an assortment of holes 32 which may be arranged in a round, staggered configuration (as shown in FIG. 1), an evenly distributed configuration, or in a variety of other patterns to suit the needs of the user. The holes 32 are configured to accommodate a pin 50, which allows for the surface 31 to be customizable. Typically, the pins 50 will be manufactured from the same material as the pallet 10 (e.g. steel, polypropylene), but may also be constructed from a different material to fit the needs of the user. As is shown in FIG. 3, each pin 50 will typically fit through one of the holes 32 of the top surface 31 and rest on a bottom surface 35, which can also have a plurality of holes 36 that are aligned with holes 32. This allows narrower head portions 51 of pins 50 to sit inside of bottom surface 35, securing the pins 50 in an upright position. As is show in FIG. 2, multiple pins 50 can be utilized in such an arrangement to secure parts 70 of various shapes and sizes.

Although not exhaustive, the following dimensions may illustrate typical uses of the adjustable pallet 10 described herein. The base of the pallet 10 may have any height and width desired, but typically may range from between 32" and 90" across (e.g. 32"×45", 45"×45", 90"×90", etc.). The height of the pallet 10 can also vary based on the demands of the user and the stability of the support arms, but may range between 12" and 48" or other dimensions. Another aspect of the pallet 10 is the pinhole pattern of the top surface 31. In some embodiments, each row 33 of holes 32 is 2" apart from an adjacent row 33, but with a 1" offset 34 resulting in a round staggered pattern as seen in FIG. 1. The holes 32 of the top surface 31 can be larger (0.75" in diameter for example) than the holes 36 of the bottom surface 35 (0.50" in diameter for example). The top surface 31 may also be spaced 1.5" from the bottom surface 35, but can be made deeper or shallower based on needs such as accommodating different sizes of parts. Indeed, the gap may be determined by the length of the pins 50, which can be around 12" in length. Of course, other dimensions are possible as well.

In order to provide stability and strength to the pallet 10, particularly during forklift operation, crossbeams 37 and transverse beams 38 may be used to link the sides 39 of base 30. Such beams 37, 38 are depicted as being diagonally disposed, but other orientations are possible. As can be seen in FIGS. 4 & 5, typically the crossbeams 37 will lie between the bottom surface 35 and the top surface 31. This not only provides stability and strength to the pallet 10, but also can prevent the top surface 31 from sagging under load, which can cause the pinholes 32 & 36 to be out of alignment as well as prevent forklifts from damaging the pallet 10. When the holes 32 & 36 are not aligned this can cause the pins 50 to not stand upright and hold parts in position in a desirable fashion. The transverse beams 38, on the other hand, will provide strength in the opposite direction, and also can serve to space the bottom side 40 of bottom surface 35 from a forklift fork 15 or pallet jack (not shown). This can improve performance of the pallet 10 because, as seen in FIG. 3, the narrowed ends 51 of the rearrangeable pins 50 protrude downwards. If the narrowed end 51 of a pin 50 was subjected to an upwards force (such as from a forklift) the pin 50 may become dislodged from its position. Thus, transverse beams 38 also serve the purpose of preventing the pins 50 from being dislodged accidentally once they are in place as by a forklift or the like.

Another aspect of the present disclosure is provided by the support 50 which may be used as support skis, or feet for supporting and moving the pallet 10. The supports 50 may be connected to the base 30 of the pallet 10 by connectors 51. If the supports are support skis they may include an angled portion 52 and a flat portion 53. In some embodiments the angled portion 52 can connect to the arms 20. Such elements can be welded together or connected by another process if desired. The connectors 51 can be oriented on the flat portion 53 of the skis such that the gaps between the support 50 and the base 30 can easily accommodate the tines 16 of a typical lifting fork 15 (as shown in FIG. 2) for easier transportation around a warehouse floor, shipping container storage, or similar area.

Looking now to FIGS. 6, 7, & 8, another embodiment of an adjustable pallet according to this disclosure is shown. Here, it should be noted that similar elements will be denoted by similar reference numbers to the first embodiment, but will be preceded by a one hundred series. As such, an elongated pallet 100 is constituted of arms 120, base 130, and support 150. In this embodiment, arms, 120 are often extended and reinforced with angle iron 122. As shown in FIGS. 6 & 7 arms 120 can be tipped by dowel heads 121 which are matable to the bottom side of arms 120 such that multiple pallets can be stacked. In certain cases, dowel heads 121 can be removable as indicated in FIG. 7. In addition to extended arms, in this embodiment, base 130 having surface 131 may have a short side 134 and a long side 135. Typically, the base 130 will also have a divider 133 that halves the elongated surface 131 into two equal halves 140 & 141. The surface 134 has a pattern of holes 135 which are mirrored at a bottom surface (not shown) as in the embodiment of FIG. 1. As shown in FIG. 7, crossbeams 137 and transverse beams 138 may diagonally (or otherwise) link the sides of base 130 providing structural support as in previous embodiments. The support 150 is connected to the base 130 by connectors 151 which attach to flat portions 153, while angled portions 152 may attach to the arms 120. In such an embodiment, it can be desirable to concentrate connectors 151 near to the central divider 133. This orientation can provide additional support for the pallet 100, and can make it easier for a forklift to carry the pallet 100 by focusing connections in the center, allowing for multiple orientations for a typical forklift to insert a lifting fork 15 without needing undue precision and accuracy on the part of the forklift operator.

FIG. 8 shows the pallet 100 of FIGS. 6 & 7 with a cover 200 according to the present disclosure. The cover 200, while shown in conjunction with pallet 100, may also be adapted to use with other pallets disclosed herein. Cover 200 can provide protection for parts stored on the pallet 100 from falling objects, water damage, dust, and a host of other potential hazards. In addition it can prevent, as a failsafe mechanism, parts from falling out of the pallet 100 if it is tilted to an extreme angle. To achieve this result, cover 200 has top 201, sides 202 & 203, and may be outfitted with vents 204 and/or corrugations 205. The vents 204 can help with drying and ventilating the parts, which can be desirable if the parts being held by the pallet 100 have been recently painted. The corrugations 205 can, in certain instances, increase the strength of the cover, or provide convenient handholds for someone placing the cover onto or removing the cover from the pallet 100.

Turning now to FIG. 9, another embodiment of an adjustable pallet according to this disclosure is shown. In such an embodiment, pallet or tray 300 has ledge 360 to complement arms 320, base 330, and support 350 that are similar in operation to their analogues in other embodiments disclosed herein. Ledge 360 may be mounted on sides 334 of the base 330 preventing them from being flush with top surface 331. As with previous pallets 10 & 100, pallet 300 can be used with pins 50. Pins 50 are cylindrical in shape, and thus may be prone to rolling over the sides of flat pallet (e.g. sides 134 & 135 of pallet 100). Ledge 360 prevents pins 60 or other rounded objects (not show) from rolling off of the pallet 300. This may be particularly useful during transport between workstations as pins 50 may be stored on surface 331, or may become dislodged from holes 332. In addition, ledge 360 can provide increased structural integrity to the pallet 300 which may be desired in certain applications.

FIG. 10 shows part holder 400 that can be affixed to the top surface of a pallet 10. The part holder 400 can be used in lieu of, or in combination with pins 50. The part holder 400 may include a bottom portion 410 (for standing on the top surface 31) and may have a plurality of holes 411, and/or slots 412 for receiving a plurality of bolts 450, or other fasteners. The bolts 450 may fasten the holder 400 to the top surface 31 of the pallet 10 by attaching nut 451, or the like, to the underside 41 of the top surface 31. Attached to the bottom portion 410 is a T-beam portion 420 having a web 421, and a flange 422 which turns into an angled portion 430 at the top of the T-beam portion. In certain embodiments, a softer backing 425 covers the flange 422 of the T-beam portion 420 and angled portions 430 to prevent scratching or other damage to the parts being held. Generally, the holder 400 is made from aluminum, polypropylene, vinyl, or plastic foam, however, other metals and polymeric materials may be selected by the user for forming the holder 400 according to the elasticity, hardness, durability, and other requirements of the user.

FIG. 11 depicts an alternative embodiment for the part holder or stand, designated by reference numeral 500. As illustrated, the part holder 500 includes a bottom 510 from which first and second sides 512 and 514 upwardly extend and which are joined by cross-beam 516. Each of the sides 512, 514 terminate in top angled positions 518, 520 respectively. The bottom 510 includes a slot 530 which may be parallel to the sides 512, 514, or perpendicular thereto, angled, diagonally disposed, or otherwise transverse. In so doing, a bolt or fastener (not shown) can be used to secure a pallet in multiple positions to best accommodate a given part.

FIG. 12 depicts yet another embodiment of a part holder or stand and is designated by reference numeral 600. The part holder 600 again includes a bottom 610, but differs by having four sides 612, 614, 616 and 618. The sides may terminate in a cap (not shown). The bottom 610 again includes a slot 630 to receive a fastener. The slot 630 may be provided diagonally as shown, or could be perpendicular, parallel or otherwise angularly disposed to allow for different positions of the stand 600 relative to a pallet.

An alternative embodiment of a support pin, designated by reference numeral 700 is shown in FIG. 13. The support pin 700 is similar to the support pins 60, but includes a locking tab 702. The locking tab 702 may be depressible radially inwardly and be spring biased radially outwardly. In so doing, when the support pin 700 is inserted into one of the pallet holes 32, the locking tab 702 may depress radially inward to allow movement past the hole 32, and then once below the top surface 31 of the pallet 10, the locking tab 702 may move radially outward to prevent upward removal of the pin 700.

Finally, in FIG. 14, an alternative embodiment of a pallet is shown by reference numeral 800. The pallet 800 is similar in many respects, but it will be noted that the bottom surface 35 has been removed. This provides a lower cost pallet among other things. Also, it will be noted that the top surface 31 is provided with fewer holes 32 to again reduce cost.

INDUSTRIAL APPLICABILITY

In general, the present disclosure finds utility in various applications associated with factories, warehouses, or the like. The present disclosure is also applicable in areas where the ability to form customized pallets, drying racks, or other similar structures is impractical, wasteful, or costly. Moreover, the present disclosure is particularly applicable to those places that transport small or midsized objects using forklifts and other heavy machinery, but do not have standardized working conditions for all the transportation of materials (such as an assembly line).

Adjustable pallets can also provide a solution that can reduce costs associated with 3-D printing, or otherwise forming individualized customized surfaces for holding, transporting, and storing parts. In addition, milling, painting, or other industrial activities may be performed on the surface of the adjustable pallets and then the completed product can be transported to a second industrial process without removal from the pallet. For example, one may first cut a part on the pallet, sand it, paint it, and then transport it to another area of the factory for drying all with the same pallet.

Turning to FIG. 2, an example of the flexibility of operation of pallet 10 is shown. As shown, pins 50 can be arranged to mount either of the oddly shaped parts 70 & 71. In order to prevent parts 70 & 71 from slipping, the user simply places the parts onto patterned surface 31 in the desired formation (in this example, a triangular part 71 sits in the front corner and a curved part 70 sits to its left), then proceeds to affix the pins 50 into the holes 32 adjacent the parts being secured. The pins 50 will be secured in place by the lower surface 35 by mating with the holes 36 (as shown in FIG. 3). Depending on how tightly pins 50 secure the parts 70 & 71, a user can then simply lift the part 70 out of its position and replace it, or can remove the pins 50 before moving the part 70. Once the parts 70 no longer need to be placed on pallet 10, the pins 50 can be removed and the pallet 10 can be reused for a new set of parts with vastly different geometries. Moreover, the pallet can be easily cleaned (particularly following painting) compared to a specifically fabricated custom pallet (not shown) as only the flat upper surface 31 and pins 50 (which can be independently machine washed) make contact with the parts 70 & 71.

Finally, the ability to customize the pallet 10 for any shape or size of a part is further enhanced by use of the custom part holders 400 (as seen in FIG. 10). These holders 400 can be rotated about the holes 411 to allow for the padded surface 425 to tightly secure the part 70. In addition, the range of each hole 32 can be extended by utilizing one of the slots 412 on the part holders 400 which can then be slid into position before tightly securing an edge of the part 70. Similar to pins 50, part holders 400 can be quickly moved and replaced to accommodate new parts 71 once the user is finished.

The above description is meant to be representative only, and thus modifications may be made to the embodiments described herein without departing from the scope of the disclosure. Thus, these modifications fall within the scope of present disclosure and are intended to fall within the appended claims.

What is claimed is:

1. A modular pallet system comprising:

a pallet, the pallet including a rectangular base having a planar top surface, and a planar bottom surface spaced apart from the planar top surface, the planar top surface having a plurality of holes arranged thereon, and the planar bottom surface having a plurality of holes arranged to align with the holes of the planar top surface, the holes of the planar bottom surface being smaller in diameter than the holes of the planar top surface;

a plurality of stacking arms extending upwardly from the rectangular base, the arms being oriented generally perpendicular to the top surface;

a support connected to the bottom of the base for supporting the modular pallet;

a plurality of part holders cooperable with the top surface of the base and mounted on the base generally perpendicular to the top surface, a first part holder in the plurality of part holders including:

a bottom portion for standing on the top surface of the base, the bottom portion including at least one hole for a fastener;

a T-beam portion having a web, a flange, and spanning upwardly from the bottom portion, the web of the T-beam facing towards the hole on the bottom portion; and an angled portion at the top of the T-beam portion, wherein the angled portion angles towards the web of the T-beam; and a plurality of crossbeams located between the planar top surface and the planar bottom surface and oriented diagonally across the base for increasing the strength of the base.

2. The modular pallet system of claim 1, wherein second part holders of the plurality of part holders are pins having a first diameter smaller than the diameter of the holes of the planar top surface and larger than the holes of the planar bottom surface, and a second diameter located at least one end of the pins, the second diameter being smaller than the holes of the planar bottom surface, wherein the pins are mounted to the base by inserting the pins through a hole at the planar top surface and into an aligned hole at the planar bottom surface such that the pin rests on the planar bottom surface.

3. The modular pallet system of claim 2, wherein the support is cooperable with a lift fork of a forklift truck.

4. The modular pallet system of claim 1, further comprising a plurality of transverse beams located beneath the bottom surface and oriented diagonally across the base, perpendicular to the crossbeams, for increasing the strength of the base and for spacing the lift fork of a forklift truck from the bottom surface of the base.

5. The modular pallet system of claim 1, wherein the plurality of stacking arms each have a top portion forming a dowel and a bottom portion forming a dowel hole, the pallet being securely stackable upon a second pallet.

6. The modular pallet system of claim 1, wherein the part holder includes a second pliable layer covering the flange of the T-beam and angled portions of the plurality of part holders.

7. The modular pallet system of claim 1, further comprising a cover, the cover being matable with the top surface of the base and the plurality of stacking arms for protecting the top surface and part holders from disturbances.

8. A pallet for transporting a plurality of differently shaped parts, the pallet comprising:

a rectangular base having a planar top surface, the top surface having a plurality of holes arranged thereon in a round staggered configuration;

a plurality of part holders cooperable with the top surface of the rectangular base and mounted on the base generally perpendicular to the top surface, a part holder in the plurality of part holders including:

a bottom portion for standing on the top surface of the base, the bottom portion including at least one hole for a fastener;

a T-beam portion having a web, a flange, and spanning upwardly from the bottom portion, the web of the T-beam facing towards the hole on the bottom portion; and an angled portion at the top of the T-beam portion, wherein the angled portion angles towards the web of the T-beam;

a plurality of support skis connected to the underside of the rectangular base, each ski located along the underside of an edge of the rectangular bed;

a plurality of rectangular pillars located at the corners of the rectangular base and extending upwardly, each of the pillars connected at the side to an end of at least one of the skis;

a plurality of stacking arms extending upwardly from the rectangular base, the arms being oriented generally perpendicular to the top surface; and a corrugated cover, the corrugated cover being matable with the top surface of the base and the plurality of stacking arms for protecting the top surface and part holders from disturbances.

9. The pallet of claim 8, wherein the rectangular base further has a planar bottom surface below the top surface, the bottom surface having a plurality of holes arranged to align with the holes of the top surface, the holes of the bottom surface being smaller in diameter than the holes of the top surface.

10. The pallet of claim 9, further comprising an edge covering the sides of the rectangular base, the edge extending higher than the top surface of the base and extending lower than the bottom surface of the base.

11. The pallet of claim 8, further comprising a plurality of angle irons connected to an interior edge of the rectangular pillars for reinforcing the pillars.

12. The pallet of claim 8, wherein each of the plurality of skis includes a flat body portion and at least one end portion located at an end of the ski, the end portion angling upwards towards the planar bottom surface without contacting said bottom surface.

13. The pallet of claim 12, wherein each of the plurality of skis is connected to the base only at the flat body portion of each ski, the connections spaced to accommodate a lift fork of a forklift truck.

14. An adjustable pallet for holding parts, the adjustable pallet comprising:

a rectangular base having a planar top surface, and a planar bottom surface spaced apart from the top surface, the top surface having a plurality of holes arranged thereon in a round staggered configuration, and the bottom surface having a plurality of holes arranged in a round staggered configuration to align with the holes of the top surface, the holes of the bottom surface being smaller in diameter than the holes of the top surface, and a support connected to the bottom of the base for supporting the adjustable pallet; and a plurality of part holders cooperable with the top surface of the base and mounted on the base generally perpendicular to the top surface; wherein a part holder in the plurality of part holders comprises:

a bottom portion for standing on the top surface of the base, the bottom portion including at least one hole for a fastener;

a T-beam portion having a web, a flange, and spanning upwardly from the bottom portion, the web of the T-beam facing towards the hole on the bottom portion; and an angled portion at the top of the T-beam portion, wherein the angled portion angles towards the web of the T-beam.

15. The adjustable pallet of claim 14, further comprising a plurality of arms located at the corners of the rectangular base and extending upwardly, the arms having a top portion forming a dowel and a bottom portion forming a dowel hole.

16. The adjustable pallet of claim 15 further comprising a cover, the cover matable with the top surface of the base and the arms for protecting the top surface and part holders from disturbances.

17. The adjustable pallet of claim 14 further comprising:

a plurality of crossbeams located between the top surface and the bottom surface and oriented diagonally across the base for increasing the strength of the base; and a plurality of transverse beams located beneath the bottom surface and oriented diagonally across the base, perpendicular to the crossbeams.

* * * * *